US011840912B1

(12) United States Patent
Weightman et al.

(10) Patent No.: US 11,840,912 B1
(45) Date of Patent: Dec. 12, 2023

(54) MANAGEMENT OF POWER RATE OF CHANGE

(71) Applicant: Halliburton Energy Services, Inc., Houston, TX (US)

(72) Inventors: Glenn Howard Weightman, Duncan, OK (US); Timothy Holiman Hunter, Houston, TX (US); Madhur Kohli, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/857,263

(22) Filed: Jul. 5, 2022

(51) Int. Cl.
*E21B 43/26* (2006.01)
*E21B 21/08* (2006.01)

(52) U.S. Cl.
CPC ..... *E21B 43/2607* (2020.05); *E21B 21/08* (2013.01); *E21B 43/26* (2013.01); *E21B 2200/20* (2020.05)

(58) Field of Classification Search
CPC ..... E21B 43/2607; E21B 21/08; E21B 43/26; E21B 2200/20
See application file for complete search history.

(56) References Cited

U.S. PATENT DOCUMENTS

| | | | | |
|---|---|---|---|---|
| 10,738,580 | B1 * | 8/2020 | Fischer | F04D 13/06 |
| 10,753,165 | B1 * | 8/2020 | Fischer | E21B 21/08 |
| 11,286,736 | B2 | 3/2022 | Fischer et al. | |
| 2012/0049625 | A1 * | 3/2012 | Hopwood | E21B 3/00 175/50 |
| 2020/0088202 | A1 * | 3/2020 | Sigmar | F04D 13/02 |
| 2021/0301630 | A1 * | 9/2021 | Krippner | E21B 41/0085 |
| 2022/0113702 | A1 * | 4/2022 | Jaaskelainen | E21B 43/26 |

* cited by examiner

*Primary Examiner* — James G Sayre
(74) *Attorney, Agent, or Firm* — John Wustenberg; Parker Justiss, P.C.

(57) ABSTRACT

This disclosure presents processes for controlling a hydraulic fracturing operation at a wellbore. The processes can (1) determine a system rate-of-change of power limit (ROCL) to be supplied to one or more loads, where the system ROCL is based on an individual ROCL for one or more individual power sources; (2) determine an allowable rate-of-change (ROCA) for the one or more loads such that the system ROCL is not exceeded; and (3) control the hydraulic fracturing operation based on the ROCA for the one or more loads.

17 Claims, 5 Drawing Sheets

400

MANAGEMENT OF POWER RATE OF CHANGE

BACKGROUND

In the oil and gas industry, a well that is not producing as expected may need stimulation to increase production of subsurface hydrocarbon deposits, such as oil and natural gas. Hydraulic fracturing is a type of stimulation treatment that has long been used in unconventional reservoirs. A stimulation treatment operation may involve drilling a horizontal wellbore and injecting treatment fluid into a surrounding formation in multiple stages via a series of perforations or entry points along a path of a wellbore through the formation. During each stimulation treatment, different types of fracturing fluids, proppant materials (e.g., sand), additives, and/or other materials may be pumped into the formation via the entry points or perforations at high pressures and/or rates to initiate and propagate fractures within the formation to a desired extent. Other well servicing equipment is needed to assist with the well stimulation equipment in order to successfully produce hydrocarbons from these unconventional reservoirs in a subsurface formation.

SUMMARY OF THE DISCLOSURE

In one aspect, a method to control a hydraulic fracturing operation at a wellbore is disclosed. In one embodiment, the method includes (1) determining a system rate-of-change of power limit (ROCL) to be supplied to one or more loads, where the system ROCL is based on an individual ROCL for one or more individual power sources; (2) determining an allowable rate-of-change (ROCA) for the one or more loads such that the system ROCL is not exceeded; and (3) controlling the hydraulic fracturing operation based on the ROCA for the one or more loads.

In a second aspect, a computer program product having a series of operating instructions stored on a non-transitory computer-readable medium that cause at least one processor to perform operations to control a hydraulic fracturing operation at a wellbore is disclosed. In one embodiment, the operations include (1) determining a system rate-of-change of power limit (ROCL) to be supplied to one or more loads, where the system ROCL is based on an individual ROCL for one or more individual power sources; (2) determining an allowable rate-of-change (ROCA) for the one or more loads such that the system ROCL is not exceeded; and (3) controlling the hydraulic fracturing operation based on the ROCA for the one or more loads.

In a third aspect, a system to control a hydraulic fracturing operation at a wellbore by limiting a rate-of-change of power at least one of one or more loads employed in the hydraulic fracturing operation calls for is disclosed. In one embodiment, the system includes one or more processors to perform one or more operations. In one embodiment, the one or more operations include (1) determining a system rate-of-change of power limit (ROCL) to be supplied to the one or more loads, where the system ROCL is based on an individual ROCL for one or more individual power sources; (2) determining an allowable rate-of-change (ROCA) for the one or more loads such that the system ROCL is not exceeded; and (3) controlling the hydraulic fracturing operation based on the ROCA for the one or more loads.

BRIEF DESCRIPTION OF THE DRAWINGS

Reference is now made to the following descriptions taken in conjunction with the accompanying drawings, in which.

DETAILED DESCRIPTION

Figure 1:
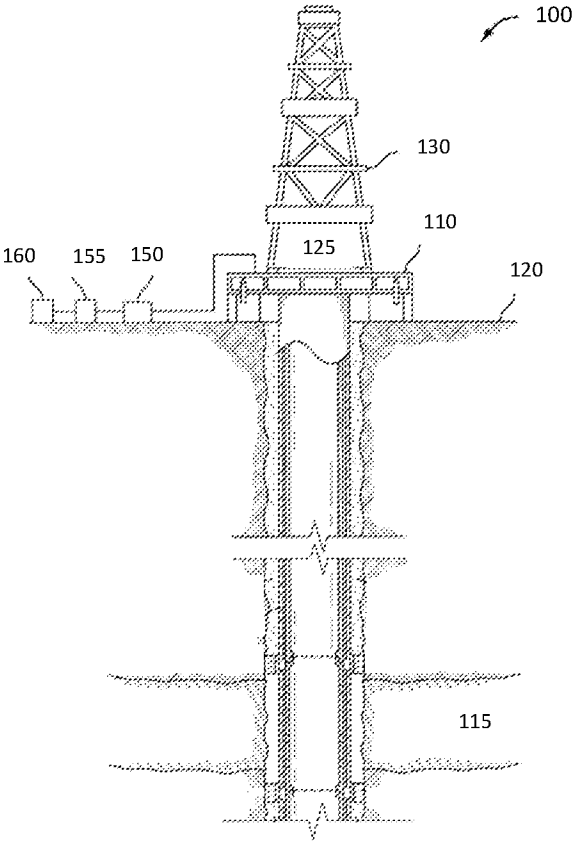
FIG. 1 illustrates an example schematic of a wellbore stimulation and servicing environment.

To enable fracturing fluids to fracture the formation, a large amount of electric power is required to drive pumping units that can create pressures needed to fracture the subsurface formation with the fracturing fluids. Many times these pumping units are driven by, e.g., variable frequency drives. These pumping units can be located at a surface above the formation typically proximate to a wellbore(s) at a well site.

The electric power can come from various sources. The various sources of electric power can fall into two general categories: locally generated power and grid (or utility) power. In both cases, power is limited both in magnitude and a rate-of-change of supply of power. Examples of locally generated power can be generators (or gensets) that are typically powered by natural gas turbines or diesel engines (however they can be generated by other means) or other types of locally generated power. Both locally generated power and utility generated electric power (typically conveyed to the well site by conventional transmission means) are limited based on the power source(s) and are subject to being depleted by the pumping units or other loads, including but not limited to blending equipment, wireline equipment, wireline pump-down pumps, control vans, water transfer equipment, sand handling equipment, etc.

These loads, without mitigation, can call for a rate of change in a supply of electric power beyond what the power sources can deliver. For example, for simple devices such as a battery, complex impedance of the battery limits an instantaneous change of power. And for complex devices such as a gas turbine generator, mechanical limitations of the generator (e.g., inertia, fuel flow, valve speed, regulation tuning, etc.) prevent an instantaneous change of power without power quality issues. Due to these limitations with electric power sources and a desire to maintain a suitable level of power quality, equipment that loads a power source should be rate-of-change limited. The determination of a desirable rate of change of electric power for a power source can be problematic, however this determination is necessary to maintain a suitable level of power quality.

Certain aspects and features of this disclosure use rate-of-change limits as a boundary to constrain a rate of power called for by various loads, e.g., fracturing equipment, to ensure that hydraulic fracturing operations can continue at a well site without an interruption caused by poor power quality (as a result of power demand changing faster than a power source can accommodate), thereby reducing the risk of power related shutdown of hydraulic fracturing operations. Such a shutdown could be minor in effect or significant. A significant shutdown can result in a long amount of non-productive time, equipment damage, and/or expensive rentals of remediation equipment. The disclosure presents various means to determine a rate-of-change limit of one or more individual power sources, ways to communicate the limit, and ways to use the limit.

FIG. 1 is a schematic diagram of a wellbore stimulation and servicing environment 100 for transferring material in and for production of material from a wellbore 105. Generally, wellbore stimulation and servicing environment 100 illustrates a system for transferring material from a surface-located hydrocarbon well site 110. The well site 110 is located over a hydrocarbon bearing formation 115 which is located below a ground surface 120. At certain times during the management and operation of the wellbore stimulation and servicing environment 100, the well site 110 may comprise a hoisting apparatus 125 and a derrick 130 for raising and lowering pipe strings, such as a work string, drill string or any other mechanism for deploying downhole tools, such as a bottom hole assembly, a drill bit, or sensors. While well site 110 is illustrated at a ground surface 120, the disclosure contemplates any one or more embodiments implemented at a well site at any location including, e.g., at sea above a subsea hydrocarbon bearing formation.

Site equipment 150 receives power from power distribution unit 155. Power distribution unit 155 may comprise various types of power equipment, devices, or mechanisms. In one or more embodiments, power distribution unit 155 may receive power from a power aggregation unit (not shown) that aggregates individual power sources comprising one or more turbines, generators (for example, an electric generator, a gas generator, a diesel generator, or any combination thereof—also not shown). In one or more embodiments, power distribution unit 155 may be used to source power to any one or more other types of equipment located at or about the well site 110 or the wellbore stimulation and servicing environment 100, e.g., site equipment 150. Each type of power source connected through, e.g., a power aggregation unit to distribution unit 155, has associated one or more known, published, or otherwise available ratings, settings, parameters or any other operating condition that identifies the optimal operating state for the power source. For example, one or more parameters associated with the operation of a power source connected to power distribution unit 155 through a power aggregation unit may include, but are not limited to, fuel type, fuel consumption, fuel quality, environmental parameters (for example, elevation, barometric pressure, temperature, humidity or other environmental condition), rated driving power, watts, voltage, amps, altitude, sound, size, rated power, rated speed, load capacity, or any other operating condition. In one or more embodiments, one or more of the environmental parameters or factors may be retrieved using a global positioning system (GPS) or weather service (for example, an online weather service or portal). In one or more embodiments any of the one or more parameters may be received, determined, or otherwise collected in real-time.

The site equipment 150, the power distribution unit 155, or any combination thereof may be controlled by one or more or more control systems, represented by control system 160. Control system 160 may be deposed or positioned at or about the well site 110 or the wellbore stimulation and servicing environment 100. In one or more embodiments, control system 160 may be located remote from the well site 110. Regardless of its location, control system 160 may comprise one or more instructions or software programs stored on a non-transitory computer-readable medium that when executed perform one or more embodiments of the disclosure. For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Control system 160 may include various types of computing devices, including, but not limited to, handheld mobile devices, tablets, notebooks, laptops, desktop computers, workstations, mainframes, distributed computing networks, and virtual (cloud) computing systems. In addition to the functions described above, the control system 160, site equipment 150, or a combination thereof can be configured to perform or direct operation of the illustrative systems and methods described herein. For example, the rate-of-change controller 500, such illustrated in FIG. 5, or the method 400 of FIG. 4 can be implemented at least in part by control system 160, site equipment 150, or a combination thereof.

Figure 2:
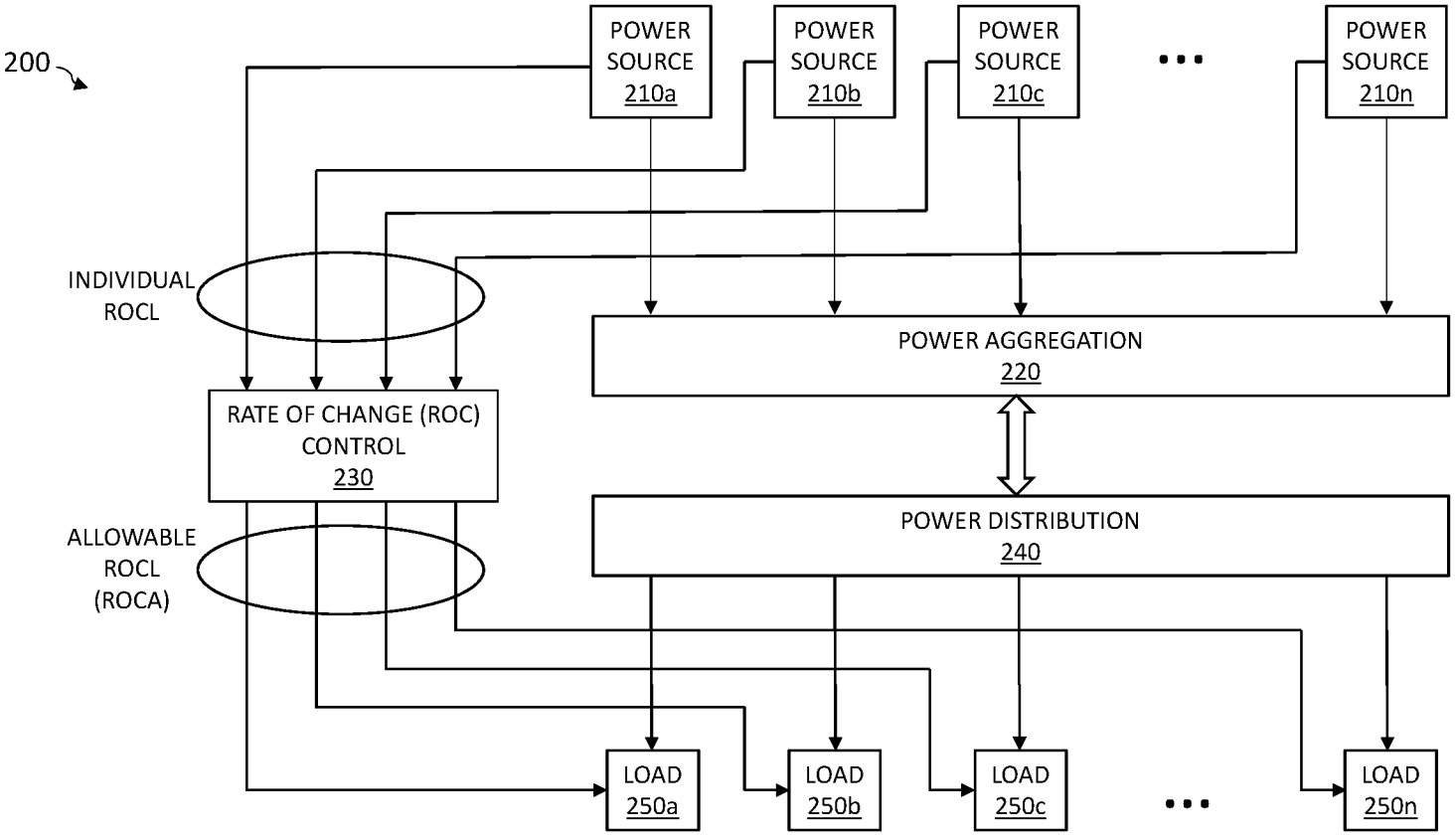
FIG. 2 illustrates a schematic of a system control a rate-of-change of power called for by various loads in a hydraulic fracturing operation.

FIG. 2 is a schematic of a system to control a rate-of-change of power called for by various loads, e.g., pumping units, from one or more power sources at a well site performing, e.g., hydraulic fracturing operations such as that described above and depicted in FIG. 1. One or more individual power sources **210*a*-210*n*, such as those described above (i.e., multiple gensets, grid/utility feeds, and/or static power sources such as a battery or fuel cell), provide their power to power aggregation unit 220. In some embodiments, only one individual power source provides power. Note that power aggregation is needed when more than one individual power source 210 is used. An example of power aggregation unit 220 can be switchgear equipment. Rate-of-change control unit 230 determines a rate-of-change limit (ROCL) for each of the individual power sources 210*a*-210*n* as disclosed below. Power aggregated by power aggregation unit 220 is provided to power distribution unit 240 (e.g., power distribution unit 155 described above). An example of power distribution unit 240 can be switchgear equipment. In embodiments where there is only one individual power source, that sole individual power source will provide its power to power distribution unit 240**.

Power distribution unit 240 provides power to loads **250*a*-250*n*, e.g., pumping units as described above. In some embodiments, only one load occurs in the hydraulic fracturing operation. Rate-of-change control unit 230 determines an allowable rate-of-change (ROCA) of power each of loads 250*a*-250*n* can call for based on its determined aggregate, or system, ROCL for the individual power sources 210*a*-210*n*** as disclosed below, ensuring that the hydraulic fracturing operation can continue at the well site without an interruption caused by poor power quality as a result of power demand changing faster than a power source can accommodate, thereby reducing the risk of power related shutdown of the hydraulic fracturing operations.

Rate-of-change control unit 230, e.g., can determine an ROCL for individual power sources, e.g., the one or more power sources **210*a*-210*n***, by, e.g., testing or inference.

Testing to determine a ROCL involve one of the individual power sources and a loading device where of a speed that the load of the loading device changes is adjustable. Examples of individual power sources here include a mobile generator and a utility power grid connection. An example of a loading device is a fluid pump driven by an electric motor or a variable frequency drive (VFD) where a ramp rate of the motor or drive is adjustable. Instrumentation can be used to monitor a relevant characteristic of the power source as different loading rates are applied. For example, output voltage from the power source could be the relevant characteristic monitored and evaluated for deviation from nominal. The loading device could perform loading runs at different, relevant loading rates. For example, an output voltage from the power source could be measured with the load at a loading rate of the loading device of 1000 watts/sec. followed by measuring the output voltage from the power source at a loading rate of the loading device of 2000 watts/sec., etc. Tests should be performed for both adding and dropping loading rates of a loading device as there can be different ROCLs for a power source between when loading is added (i.e., adding loading rates) and when loading is removed (i.e., dropping loading rates).

Inference can alternatively be used to determine a ROCL for individual power sources. Using inference to determine a ROCL for an individual power source is more involved than testing to determine a ROCL for an individual power source as disclosed above and requires monitoring system performance while in actual use and making assumptions regarding the ROCL. While the testing technique disclosed above is somewhat deterministic and essentially fixed, inference is dynamic. In one embodiment an algorithm for inferring ROCL for an individual power source is described below.

When inferring a ROCL for an individual power source, a loading devices with variable-speed drives, e.g., the fluid pump driven by an electric motor or a variable frequency drive (VFD) (e.g., the pumping units described above to create fracturing fluid pressures great enough to fracture the formation) is used. An initial rate-of-change assumption is made for these variable-speed loading devices when inferring a ROCL for the power source. A relevant characteristic of the individual power source, e.g., its output voltage, is monitored and used as a metric for determining acceptable system performance. During operation as loads increase and decrease, a supervisory control system (SCS), e.g., will calculate a rate of change of power the variable-speed loading device requires. This would be, e.g., a "live" variable and would be calculated on a software cycle using the following equation:

$$\text{Rate of Change required for Load}_i=(P_{t_2}-P_{t_1})/(t_2-t_2) \qquad \text{Eq. 1}$$

where i is a specific variable-speed load, $t_1$=time of second output voltage measurement, $t_2$=time of first output voltage measurement, $P_{t_1}$=power used by the system at $t_1$, and $P_{t_2}$=power used by the system at $t_2$.

Figure 3:
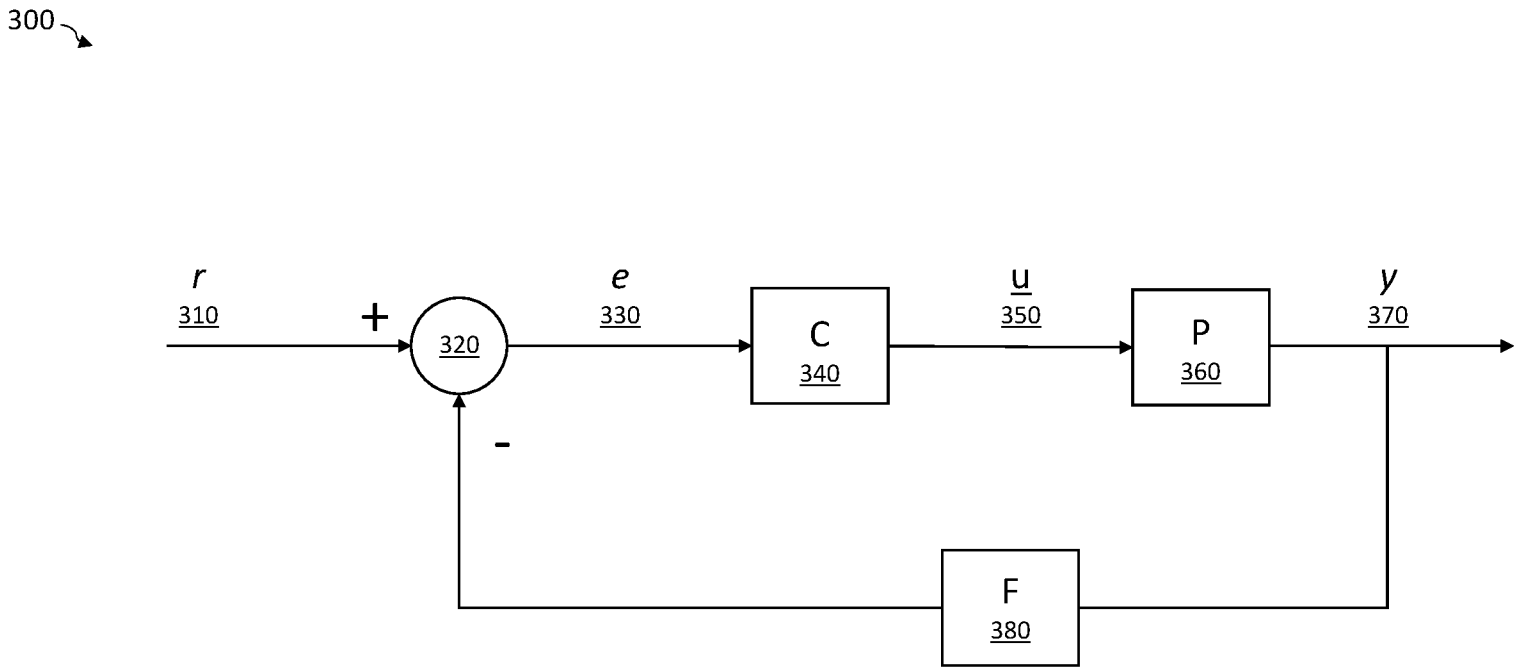
FIG. 3 illustrates an example of a closed-loop algorithm to infer a rate-of-change limit for a given individual power source.

A proportional-integral-derivative (PID) control loop mechanism or another closed-loop algorithm can change the ROCL for a given individual power source, e.g., power source 210*a*-210*n*, based on a value of a relevant characteristic of the individual power source, e.g., an output voltage. Consider the following example of a closed loop algorithm 300 to infer a ROCL for an individual power source, as illustrated in FIG. 3, where the relevant characteristic for the individual power source may be a line voltage into a system, indicated as "r" (310) in FIG. 3. In this example, r is 13.8 kV. In FIG. 3, "y" (370) is a system voltage as measured by an instrument F (380). The output of instrument F is applied to a minus terminal (−) of summing junction 320 with line voltage r (310) applied to a plus terminal (+) of summing junction 320. The result of the sum from summing junction 320 is an error term "e" (330) which is a deviation from a desired set point. The deviation e (330 is used by control block C (340) to adjust the ROCL, e.g., "u" (350) in FIG. 3). The tuning of control block C is beyond the scope of this disclosure but, in general, if the error term e is positive, beyond some tolerance threshold, and the actual rate-of-change is negative, then the ROCL will be reduced. Likewise if the error term e is negative (beyond the tolerance threshold) and the actual rate-of-change is positive, then the ROCL will also be reduced. Process block C (360) operates on u (350) to produce system voltage y (370). The line voltage r into the system may not be fixed but, rather, could be dynamic and based on the system voltage y when the system is at steady state.

Knowing the ROCL for an individual power source, however, may be insufficient to describe the system ROCL for a system that includes more than one individual power source. For example, a system may have five gensets, each with a ROCL of 200 kilowatts/sec. Here, the system would have an ROCL of 1000 kilowatts/sec. However, in another example, a system may have five gensets each with a ROCL of 200 kilowatts/sec and a utility grid connection that has an ROCL of 100 kilowatts/sec. In this example, the gensets would be synchronized in voltage to the grid power source, assuming a common input bus. Depending on how the genset controls are configured, the system ROCL may be constrained by the grid connection or the system ROCL may be dominated by the genset connections. A supervisory control system (SCS) could determine the system ROCL based on the ROCLs of individual power contributors, e.g., individual power sources, that are online at a given time. This determination of the system ROCL would likely be dynamic and, thus, track the status of potential power contributors. By limiting the rate-of-change of power called for by the loads of the hydraulic fracturing operation to the system ROCL for the one or more power sources, the power-related shutdown of the hydraulic fracturing operation can be avoided.

As noted above, this disclosure describes ways to communicate the system ROCL disclosed above. Various power available values need to be communicated through various systems of the hydraulic fracturing operation. This communication can be accomplished through networked digital data, analog signals, or a combination thereof. In one embodiment, the networked digital data can be, e.g., User Datagram Packets (UDP) sent over an Internet Protocol (IP) based network running on, e.g., Ethernet. In another embodiment, an example of analog signals is a 4-20 mA current loop where 4 mA represents one power level and 20 mA represents a higher power level. However, any digital networking protocol or analog signaling protocol could be used to communicate the various power available values between the various systems of the hydraulic fracturing operation.

Communication could also occur between the loads, e.g., variable-speed loads such as individual loads 250*a*-250*n*, and a supervisory control system (SCS) which manages the variable-speed loads. An intelligent power source, e.g., could have knowledge of the above-described system ROCL which is communicated to the SCS. The SCS would then communicate an allocation of the system ROCL, e.g., the ROCA disclosed above, to the variable-speed loads as disclosed below. In one embodiment, e.g., the SCS could be included in the rate-of-change control unit 230 disclosed above.

Once the system ROCL has been determined, e.g., as disclosed above, various techniques can be employed for various loads, e.g., loads 250*a*-250*n* of FIG. 2 disclosed above, to use the system ROCL to ensure that the hydraulic fracturing operation can continue at the well site without an interruption. To accomplish this, local control systems of each load must not call for a higher rate of change of power than the system ROCL can allow. As such, loads must be constrained by the individual, allowable rate of change (ROCA) for each load.

One technique to employ a ROCA for individual loads is to further utilize the SCS as disclosed above. Here, the SCS can allocate a ROCA to the loads using an algorithm. In one embodiment, e.g., for ten roughly equivalent loads, the SCS would divide the ROCL by ten to generate a ROCA for each load and instruct each load to call for no more than this generated ROCA. Of course, the SCS could use any other algorithm to generate a load-specific ROCA. In some embodiments, the load-specific ROCA generated by the SCS could be different for each specific load. In other embodiments, the algorithm of the SCS to generate a load-specific ROCA could be based on different objectives. For example, the algorithm of the SCS could generate a load-specific ROCA based on an importance of the load where, if a load was deemed more important, the algorithm of the SCS would generate a higher ROCA for that load.

Another technique to employ a ROCA for individual loads would be for a controller local to a specific load to use the system ROCL to make a unilateral decision on the ROCA for that load without communicating with any other load or with any central control, e.g., the SCS disclosed above. With this technique the local controller of a specific load could, knowing the system ROCL and a number of loads, unilaterally generate a standard ROCA for that load. For example, if the local controller of an individual load with knowledge of the system ROCL and n number of loads, could generate a ROCA for that load of the system equaling ROCL/n. In another example local controller making unilateral decisions on a ROCA for its associated load, assume five loads where a first and second load each are to use 25% of the system ROCL, a third and fourth load each are to use 20% of the system ROCL, and the fifth load is to use 10% of the system ROCL, where the system ROCL can be dynamic. Here, the local controllers of each of the first and second loads would unilaterally generate a ROCA for each respective load equaling 25% of the system ROCL, the local controller of each of the third and fourth loads would unilaterally generate a ROCA for each respective load equaling 20% of the system ROCL, and the local controller for the fifth load would unilaterally generate a ROCA for its load equaling 10% of the system ROCL. Of course other bases for generating a ROCA for a respective load by that load's local controller could be used.

Another technique to employ a ROCA for individual loads would for each local controller of each specific load to generate a fixed ROCA for each load without knowledge of a system ROCL. In this case, the value of the fixed ROCA would be determined offline and entered into each local controller for later use. In this case, the ROCA could not be dynamic, i.e., based on a changing ROCL and the ROCA generated offline would have to use a very conservative assumption for a system ROCL. In one embodiment, this assumption for the system ROCL could be based, e.g., on a derating of low value of a system ROCL based on historic trends.

Figure 4:
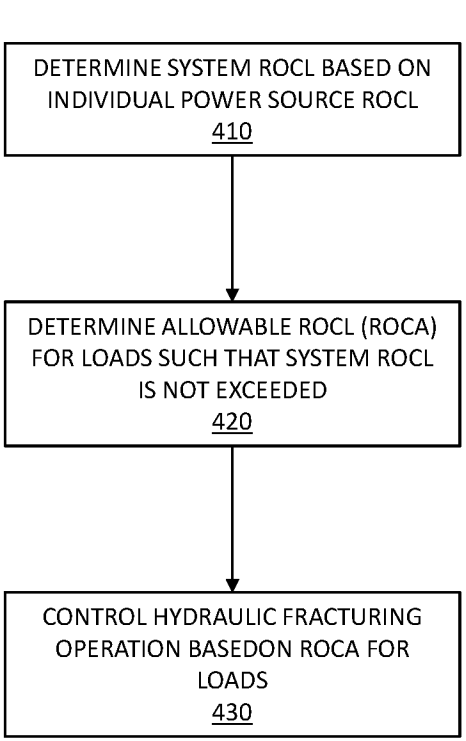
FIG. 4 illustrates a flow diagram of an example for controlling hydraulic fracturing operations according to principles of the disclosure.

FIG. 4 illustrates a flow diagram of a method 400 of controlling hydraulic fracturing operations according to principles of the disclosure. At least a portion of method 400 can be performed by a system for controlling the rate-of-change the one or more power sources of the hydraulic fracturing operation can support and for controlling the rate-of-change each load of the hydraulic fracturing operation can call for, such as disclosed in FIG. 5 below. Method 400 starts in step 410 where a system ROCL is determined based on a ROCL for individual power sources. This determination of the ROCL for the individual power sources can use the testing or inference methods disclosed above where the inference method can use, e.g., an algorithm disclosed above represented by Equation 1 or other algorithms. Once the system ROCL is determined, e.g., by control system 160 disclosed above with regard to FIG. 1 or rate-of-change control 230 with regard to FIG. 2, step 420 of method 400 determines an allowable rate-of-change (ROCA) for specific loads, e.g., loads 250*a*-250*n* of FIG. 2. As discussed above, the sum of each determined ROCA must not exceed the system ROCL determined in step 410 in order for the hydraulic fracturing operation to not shut down due to power quality issues. Once a determination of the ROCA for each individual load is determined in step 420, step 430 of method 400 controls the hydraulic fracturing operation. That is, the rate-of-change of power, e.g., 100 kilowatts/sec, called for by a specific individual load, e.g., a pumping unit, is governed by the ROCA determined in step 420 for the specific load (assuming that in step 420 it is determined that that specific load cannot call for more than a 100 kilowatt/sec rate-of-change).

Figure 5:
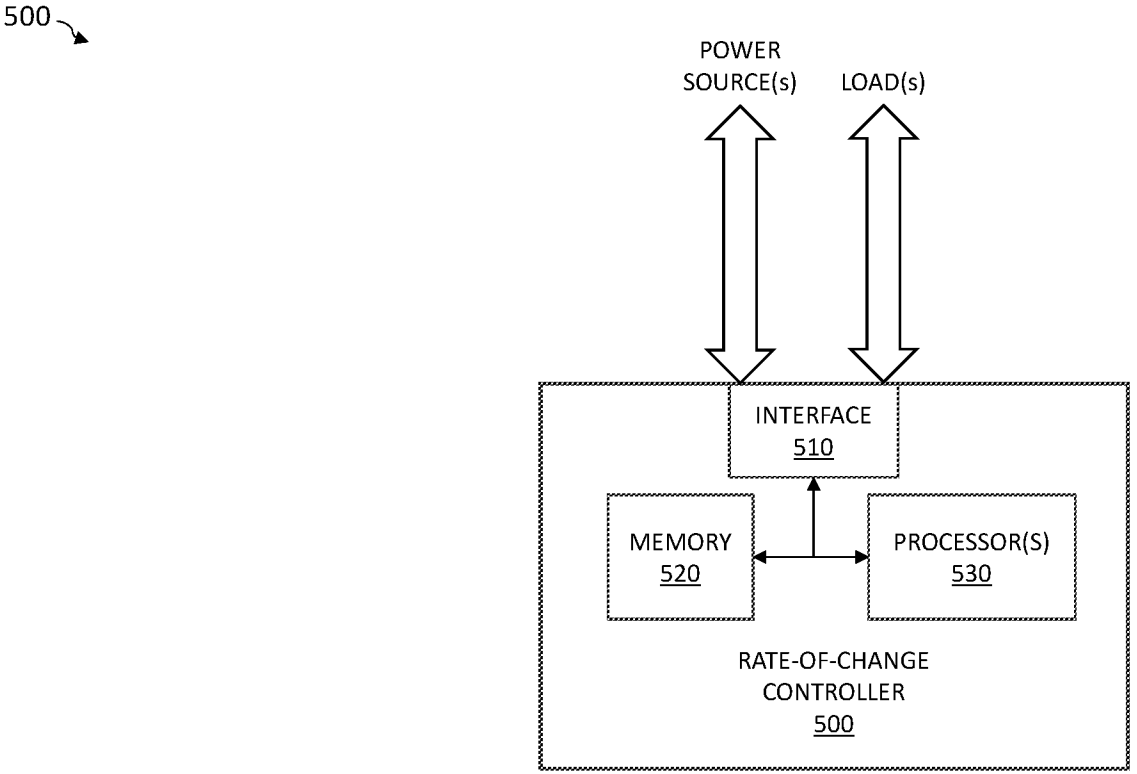
FIG. 5 illustrates a block diagram of an example computing system for use according to the principles of the disclosure.

Computing system 500, illustrated in FIG. 5, provides an example of one or more control systems, such as control systems 160 or rate-of-change control 230 disclosed above. Furthermore, computing system 500 could be the SCS disclosed above or the local controller of a load disclosed above. Computing system 500 can be located proximate a well site, or a distance from the well site, such as in a data center, cloud environment, corporate location, a lab environment, or another location. Computing system 500 can be a distributed system having a portion located proximate a well site and a portion located remotely from the well site. Computing system 500 includes a communications interface 510, a memory (or data storage) 520, and one or more processors 530.

Communication interface 510 is configured to transmit and receive data. For example, communication interface 510 can receive data from power sources, e.g., power sources 210*a*-210*n*, and transmit data to individual loads, e.g., loads 250*a*-250*n* during a stimulation operation, e.g., a hydraulic fracturing operation.

Memory 520 can be configured to store a series of operating instructions that direct the operation of the one or more processors 530 when initiated, including code representing the algorithms for determining the individual ROCLs of the one or more individual power sources based on the data received from the one or more power sources and representing the algorithms for determining the individual ROCAs for the individual loads based on a system ROCL using the determined individual ROCLs of the one or more individual power sources. Memory 520 is a non-transitory computer readable medium. Memory 520 can be a distributed memory.

The one or more processors 530 are configured to determine the individual ROCLs of the one or more individual power sources using, e.g., the algorithms disclosed above for the testing and inference methods where the inference method can use, e.g., Equation 1 when inferring the ROCL of the individual load. The one or more processor 530 are also configured to determine the individual ROCAs for the individual loads using any or all of the techniques disclosed above. The one or more processors 530 include the logic to communicate with communications interface 510 and memory 520, and perform the functions described herein.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, because the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

What is claimed is:

1. A method of controlling a hydraulic fracturing operation at a wellbore, the method comprising:

determining a system rate-of-change of power limit (ROCL) to be supplied to one or more loads, wherein the system ROCL is based on an individual ROCL for one or more individual power sources by either testing the one or more individual power source, inferring a ROCL for the one or more individual power sources, or both;

determining an allowable rate-of-change (ROCA) for the one or more loads such that the system ROCL is not exceeded; and controlling the hydraulic fracturing operation based on the ROCA for the one or more loads.

2. The method of claim 1, wherein at least one of the plurality of loads is a pumping unit for pumping fracturing fluid into the wellbore during the hydraulic fracturing operation.

3. The method of claim 1, further comprising communicating the system ROCL to the one or more loads.

4. The method of claim 1, further comprising allocating the ROCA to the one or more loads to control the hydraulic fracturing operation via an algorithm.

5. The method of claim 1, further comprising allocating the ROCA unilaterally by the one or more loads to control the hydraulic fracturing operation.

6. The method of claim 1, further comprising allocating a fixed ROCA to the one or more loads to control the hydraulic fracturing operation.

7. A computer program product having a series of operating instructions stored on a non-transitory computer-readable medium that cause at least one processor to perform operations, the operations comprising:

determining a system rate-of-change of power limit (ROCL) to be supplied to one or more loads, wherein the system ROCL is based on an individual ROCL for one or more individual power sources by either testing the one or more individual power source, inferring a ROCL for the one or more individual power sources, or both;

determining an allowable rate-of-change (ROCA) for the one or more loads such that the system ROCL is not exceeded; and controlling a hydraulic fracturing operation based on the ROCA for the one or more loads.

8. The computer program product of claim 7, wherein at least one of the one or more loads is a pumping unit for pumping fracturing fluid into the wellbore during the hydraulic fracturing operation.

9. The computer program product of claim 7, wherein the inferring the ROCL for the one or more individual power sources includes an initial assumption for the ROCL for the one or more individual power sources.

10. The computer program product of claim 7, wherein the inferring the ROCL for the one or more individual power sources is based on a relevant characteristic of the one or more individual power sources.

11. The computer program product of claim 7, wherein the system ROCL changes based on any of the one or more individual power sources changing its capability to provide power.

12. A system to control a hydraulic fracturing operation at a wellbore by limiting a rate-of-change of power at least one of one or more loads employed in the hydraulic fracturing operation calls for, the system comprising:

one or more processors to perform one or more operations including:

determining a system rate-of-change of power limit (ROCL) to be supplied to the one or more loads, wherein the system ROCL is based on an individual ROCL for one or more individual power sources by either testing the one or more individual power source, inferring a ROCL for the one or more individual power sources, or both;

determining an allowable rate-of-change (ROCA) for the one or more loads such that the system ROCL is not exceeded; and controlling the hydraulic fracturing operation based on the ROCA for the one or more loads.

13. The system of claim 12, wherein at least one of the one or more loads is a pumping unit for pumping fracturing fluid into the wellbore during the hydraulic fracturing operation.

14. The system of claim 12, further comprising a supervisory control system (SCS) which communicates the system ROCL to the one or more loads.

15. The system of claim 12, further comprising a supervisory control system (SCS) which allocates the ROCA to the one or more loads to control the hydraulic fracturing operation via an algorithm.

16. The system of claim 12, further comprising a control system local to each of the one or more loads which allocates the ROCA unilaterally to control the hydraulic fracturing operation.

17. The system of claim 12, further comprising a control system local to each of the one or more loads which uses a fixed ROCA to control the hydraulic fracturing operation.

* * * * *